US009120593B2

(12) United States Patent
Mena et al.

(10) Patent No.: US 9,120,593 B2
(45) Date of Patent: Sep. 1, 2015

(54) BOX WITH INTEGRATED COLLAPSIBLE DIVIDERS

(71) Applicant: Summit Container Corporation, Monument, CO (US)

(72) Inventors: Jesse Joe Mena, Manitou Springs, CO (US); Daniel Kenneth Reichenberg, Monument, CO (US); Leigh Ann Kingman, Denver, CO (US); David G. Johnson, Colorado Springs, CO (US)

(73) Assignee: Summit Container Corporation, Monument, CO (US)

( * ) Notice: Subject to any disclaimer, the term of this patent is extended or adjusted under 35 U.S.C. 154(b) by 0 days.

(21) Appl. No.: 13/761,534

(22) Filed: Feb. 7, 2013

(65) Prior Publication Data

US 2014/0217160 A1 Aug. 7, 2014

(51) Int. Cl.
*B65D 5/49* (2006.01)
*B65D 5/48* (2006.01)

(52) U.S. Cl.
CPC ..... *B65D 5/48024* (2013.01); *B65D 5/48014* (2013.01)

(58) Field of Classification Search
CPC ..... B65D 5/48024; B65D 5/48026
USPC ..... 229/120.02, 120.04, 120.08, 120.09, 229/120.14, 120.19, 120.31, 120.37, 229/120.38, 120.24, 120.15; 206/192
See application file for complete search history.

(56) References Cited

U.S. PATENT DOCUMENTS

| | | | | |
|---|---|---|---|---|
| 1,737,950 | A | 12/1929 | Scotland | |
| 1,859,537 | A | 5/1932 | Shofer | |
| 1,890,965 | A | 12/1932 | Boeye | |
| 2,078,907 | A | 4/1937 | Kondolf | |
| 3,115,290 | A | 12/1963 | Byassee | |
| 3,184,142 | A | 5/1965 | Rosenburg | |
| 4,335,842 | A | 6/1982 | Bradford et al. | |
| 4,482,055 | A * | 11/1984 | Boyle | 229/235 |
| 4,498,420 | A | 2/1985 | Botterman et al. | |
| 5,495,983 | A | 3/1996 | Lelek | |
| 6,012,630 | A | 1/2000 | Block | |
| 7,219,797 | B2 * | 5/2007 | Kroeze et al. | 206/423 |
| 2003/0146269 | A1 * | 8/2003 | Auclair et al. | 229/120.24 |
| 2009/0084835 | A1 * | 4/2009 | Tibbels et al. | 229/120.18 |

OTHER PUBLICATIONS

Fibre Box Handbook, Fibre Box Association, www.fibrebox.org, 2 page, 2005.

* cited by examiner

*Primary Examiner* — Christopher Demeree
(74) *Attorney, Agent, or Firm* — Scott A. Felder; Wiley Rein LLP

(57) ABSTRACT

A specialized box with integrated dividers is suitable for transporting multiple rectangular products, such as set top boxes. The box is formed of a single sheet of material, scored in six panels so that a leading panel forms a partition around which the other panels are folded and secured, with the final panel partially overlapping the second panel to form a joined side of the box. An insert with two walls, formed of a single sheet of material, can be folded into a rectangular shape and inserted in the box to create walls between the partition and each parallel side of the box. Cushioning pads can be attached to bottom flaps of the box. When flat, multiple boxes can be compactly stored or transported on a pallet. When folded into a cube, the box holds up to four rectangular products in four separate, protected compartments within the box.

16 Claims, 6 Drawing Sheets

BOX WITH INTEGRATED COLLAPSIBLE DIVIDERS

BACKGROUND OF THE INVENTION

1. Field of the Invention

The present invention relates to a box with integrated collapsible dividers which box is suitable for holding, protecting, and transporting multiple rectangular products but can be easily collapsed for storage when not in use.

2. Description of the Prior Art

Boxes with partitions for separating multiple products within the box are well known. Dividers or partitions, when designed and used properly, can minimize the potential for a product being scraped and injured by other products shipped in the same box. Such dividers may also support each product in a relatively safe position within the box, to help protect each enclosed product from damage due to being bounced around within a moving box, while providing cushioning from blows to the box.

For example, U.S. Pat. No. 1,859,537 to Shofer, U.S. Pat. No. 1,890,965 to Boeye, and U.S. Pat. No. 4,335,842 to Bradford et al., teach inserts which can be placed in a standard rectangular box to hold dividers between canned goods or other products. These inserts have tabs and slots suitable for maintaining the position of the insert within an unmodified, standard rectangular box.

Other boxes known in the prior art are formed from a single blank including partitions that are foldable inside the box to protect products of particular shapes and dimensions. Examples of such containers include a box for holding insects described in U.S. Pat. No. 4,498,420 to Botterman et al. and a box for transporting golf clubs taught in U.S. Pat. No. 5,495,983 to Lelek. Similarly, cartons with partitions created from a single blank are described in The Fibre Box Handbook of the Fibre Box Association and U.S. Pat. No. 1,737,950 to Scotland, U.S. Pat. No. 2,078,907 to Kondolf, U.S. Pat. No. 3,115,290 to Byassee, U.S. Pat. No. 3,184,142 to Rosenburg, and U.S. Pat. No. 6,012,630 to Block.

Although each of the boxes known in the prior art are useful for a particular purpose, transportation of rectangular electronic devices such as Set Top Boxes creates a unique set of requirements. Ideally, such boxes should provide cushioned support to protect fragile components. As a result, most containers used in the industry today have three separate components: an exterior box, a set of dividers insertable in the box to separate and protect transported products from each other, and a cushioning pad which is inserted between the dividers and products and the bottom of the box. The fact that there are three separate components to a typical box for shipping electronic products creates inefficiency and problems for certain users. For example, cable company local stores providing repair and replacement units are normally small and do not have extensive storage room. To minimize the space taken by a box when not in use, each box is routinely broken down into its three separate parts. When a need arises to rebuild the box to transport products, some of the three components may be lost or damaged. Furthermore, labor costs to reassemble the box are significant.

Currently available boxes are frequently thrown out instead of being re-used, due to space restrictions which make it impossible to store fully assembled boxes, time required to disassemble the boxes to accommodate such storage space restrictions, or difficulty in reassembling the boxes when the dividers or cushioning pad may have been separately stored and subsequently lost. The cable industry has long sought a box that can be easily broken down and stored at a local store and efficiently set back up to accept more Set Top Boxes. The claimed invention provides a long sought unique and novel solution to the cable industry's problems with using three part boxes. The claimed box with integrated dividers can typically be used to make four separate trips, which is twice the number of uses expected from currently available boxes for transporting Set Top Boxes, resulting in approximately 50% savings in packaging costs. A box with integrated dividers and cushioning, which can be easily collapsed and re-assembled, is needed to safely transport rectangular products.

SUMMARY AND OBJECTS OF THE INVENTION

A primary object of the present invention is to provide a one piece box for safely transporting several rectangular products which is easily assembled for use and conveniently disassembled for storage between multiple uses. The box is most likely to be used multiple times, with resulting economic and environmental benefits, if it consists of a single integrated structure which can be conveniently reduced to a significantly flat shape allowing numerous boxes to be stored and moved on a pallet. Providing such a box that has appropriate cushioning to protect electronic products is a significant object. Furthermore, providing such a one piece box for which the dividers and cushioning components are integrated is a significant asset to avoid losing component parts as the box is disassembled, stored, and reassembled for multiple uses.

These objects are achieved by a specialized box with integrated dividers provided in the form of a specialized insert. Like most rectangular boxes, when in a cube shape the box has opposing, parallel length-wise sides connecting on either end to opposing, parallel width-wise sides. Top flaps extending outward from top edges of each of the four box sides can be folded toward each other to form the top of the box, as is typical for cardboard boxes. Similarly, bottom flaps extending outward from bottom edges of each side can be folded toward each other to form the bottom of the box in a customary fashion. The bottom flaps and top flaps are usually taped in place to establish the top and bottom of the box in a cube shape, but the tape can be cut or removed to allow the box to be collapsed into a substantially flat shape. The integrated dividers conveniently collapse inside the sides of the box, parallel to the length-wise sides, allowing the box to assume a substantially flat form despite the presence of the dividers.

The box and integrated dividers are conveniently made of cardboard, corrugated paper, or other semi-rigid material. Cushioning pads may advantageously be attached to bottom flaps of the box to protect products in the box from the effects of being jostled during transit, which pads are advantageously constructed of foam or other materials suitable for cushioning the products.

Because the box is constructed of a single sheet of material, it is easily assembled and disassembled. In its simplest form, the box is formed from a single sheet that has been scored to establish six connected panels. The leading panel establishes a partition, around which the remaining panels are wrapped to form the exterior of the box. Each of the panels which form the exterior of the box are scored to form top flaps and bottom flaps suitable for folding inward to create the top and bottom of the box when in cube form. The leading panel which establishes a partition inside the box has a length substantially equal to the distance between the two width-wise sides of the box, when the box is constructed, and a height not greater than the distance between the top and bottom flaps of each side of the box.

Two panels of the single sheet from which the box is formed have a substantially equal height and length, suitable for forming length-wise sides of the box. Between each of those length-wise sides is a complete width-wise side, connected on each edge to one edge of the opposing length-wise sides, with a height equal to that of each length-wise side. Two partial width-wise sides are each connected to the other edge of each length-wise side, such partial width-wise sides being suitable for overlapping to form a joined width-wise side which opposes the complete width-wise side when the box is formed. The height and length of the joined width-wide side is equal to that of the complete width-wide side, when the two partial width-wise sides are partly overlapped and secured by glue or another permanent fastening means.

The simple box with an integrated partition to provide separate compartments for holding two rectangular products is well known in the industry. Beneficially, the claimed box with integrated dividers establishes four or more separate compartments while still being easily assembled and disassembled into a substantially flat, easily stored form. The key feature of this invention is a single sheet of semi-rigid material which is scored to form five segments which are folded to create a rectangular insert which is inserted into the box around the single initial partition.

The insert is secured in an advantageous position surrounding the initial partition of the box by a series of interrelated openings which are referred to in this specification as slots or grooves. Because the initial partition is formed from the same sheet of material as the box sides, that partition is connected to a partial width-wise side of the box. However, a slot, slightly larger than the thickness of cardboard and thus suitable for snugly receiving a segment of the insert, is formed between the upper portion of the initial partition and the width-wise side of the box, so that the partition is only connected to the width-wise side of the box in the lower portion of the box. Similarly, the lower portion of the partition extends to the opposite width-wise side of the box, but a cardboard-thick slot separates the upper portion of the partition from that opposite width-wise side of the box. Grooves are formed in the first, third, and fifth segments of the insert, allowing those segments to be slid into the box around the lower part of the partition, while an area of each segment without a groove fits into slots between the partition and width-wise sides of the box. The inter-related slots of the box panels and grooves of the insert segments allow the insert to fit over the partition and be held securely in place.

While the first, third, and fifth segments of the insert are held adjacent to the width-wise sides of the box, the second and fourth segments form walls stretching the length of the box. Each of the walls divides the area between the initial partition and a length-wide side of the box into two smaller compartments, each suitable for receiving and holding a rectangular product. It is possible to provide additional inserts to further divide the box into additional compartments. To provide cushioning for the rectangular products, strips of cushioning material can be beneficially attached to the bottom flaps of the box. Channels may be formed in the bottom of each wall and the partition to accommodate the cushioning material while allowing the walls and partition to extend to the bottom of the box.

Indentations may also be provided at the top of each wall and the partition to facilitate grasping products as they are lowered into and removed from the compartments in the box.

Figure 1:
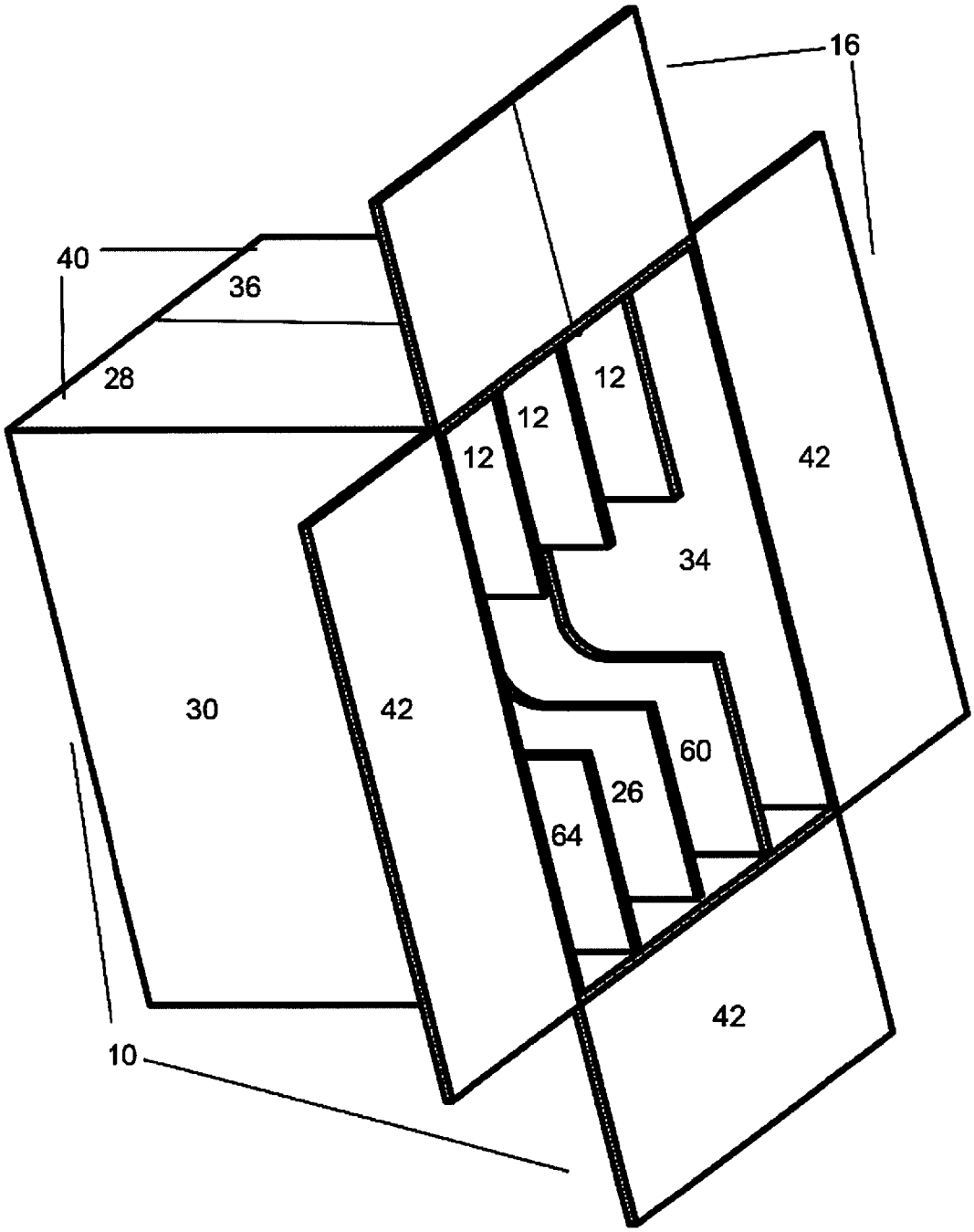
FIG. 1 is a perspective top and side view of a box with integrated dividers according to the present invention.

In the drawings, the following legend has been used:

| | |
|---|---|
| 10 | Box |
| 12 | Dividers |
| 14 | Rectangular products |
| 16 | Cube shape |
| 18 | Flat shape |
| 20 | Compartments within box |
| 22 | Single sheet from which box is formed |
| 24 | Panels of box single sheet |
| 26 | Partition |
| 28 | First partial width-wise side of box |
| 30 | First length-wise side of box |
| 32 | Complete width-wise side of box |
| 34 | Second length-wise side of box |
| 36 | Second partial width-wise side of box |
| 38 | Overlapping area of first partial width-wise side and second partial width-wise side |
| 40 | Joined width-wise side of box |
| 42 | Top flaps |
| 44 | Top of box |
| 46 | Bottom flaps |
| 48 | Bottom of box |
| 50 | Securing means |
| 52 | Slot between partition and width-wise side of box |
| 54 | Insert |
| 56 | Segments of Insert |
| 58 | First width-wise segment |
| 60 | First wall |
| 62 | Second width-wise segment |
| 64 | Second wall |
| 66 | Third width-wise segment |
| 70 | Partition tab |
| 72 | Channel in partition and walls |
| 74 | Indentation in dividers for grasping products |
| 76 | Cushioning material |
| 78 | Grooves in width-wise segments |
| 80 | Edge of partition and walls |

DESCRIPTION OF THE PREFERRED EMBODIMENT

The present invention concerns a specialized box with integrated divider. In the following description, numerous specific details are set forth in order to provide a thorough understanding of the present invention. It will be obvious, however, to one skilled in the art that the present invention may be practiced without these specific details. Some well-known methods and structures have not been set forth in order not to unnecessarily obscure the description of the present invention.

Figure 5:
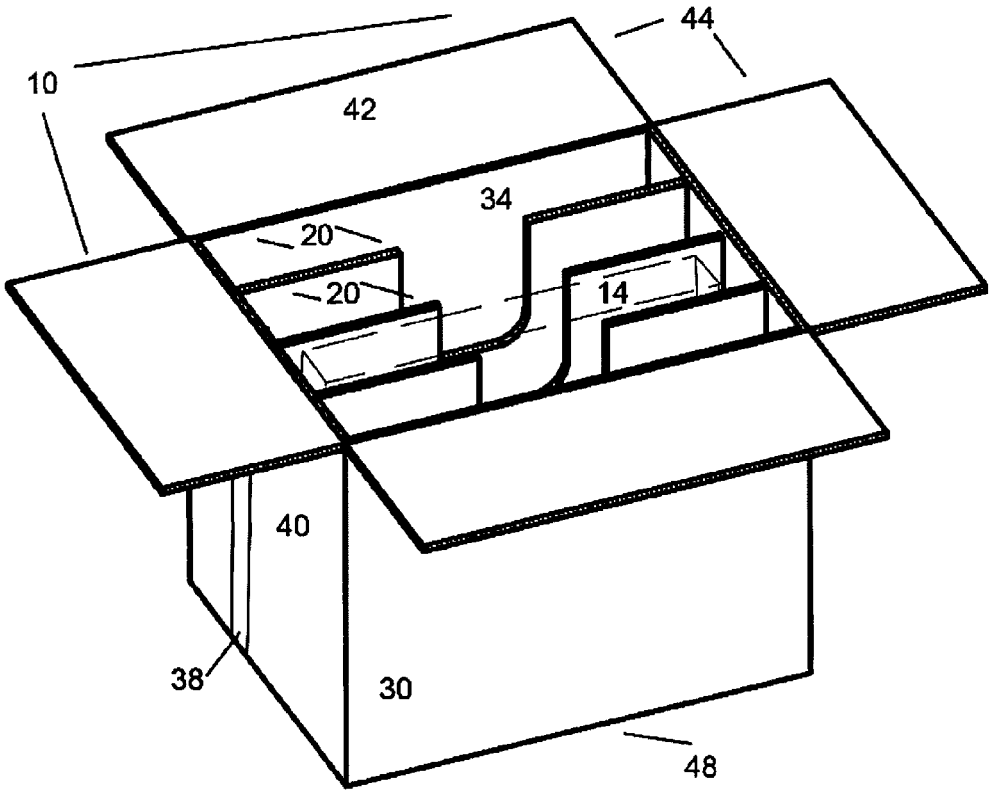
FIG. 5 is a bottom, side perspective view of the box of the present invention, shown in a cube shape.
Figure 6:
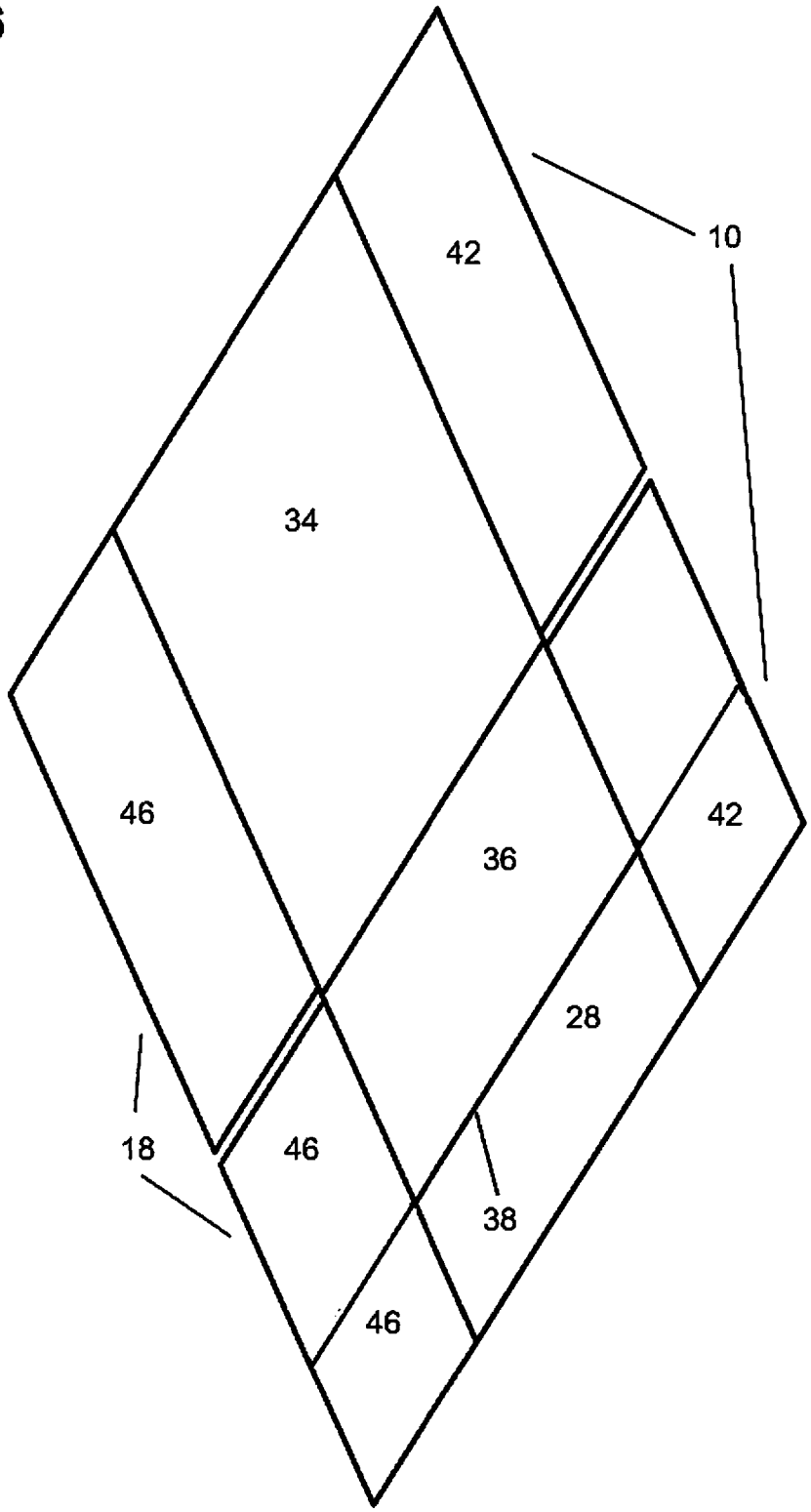
FIG. 6 is a top, side perspective view of the box of the present invention, shown in a flat shape.

As best shown in FIGS. 1 and 5, a specialized box 10 with dividers 12 is suitable to hold, protect, and transport up to four rectangular products 14. The box 10 can be easily disassembled from the cube shape 16 shown in FIG. 1, into a collapsed, substantially flat shape 18 shown in FIG. 6. In the flat shape 18, the box 10 and integrated dividers 12 can be compactly stored. The box 10 can also be easily assembled into the cube shape 16 for re-use.

Figure 3:
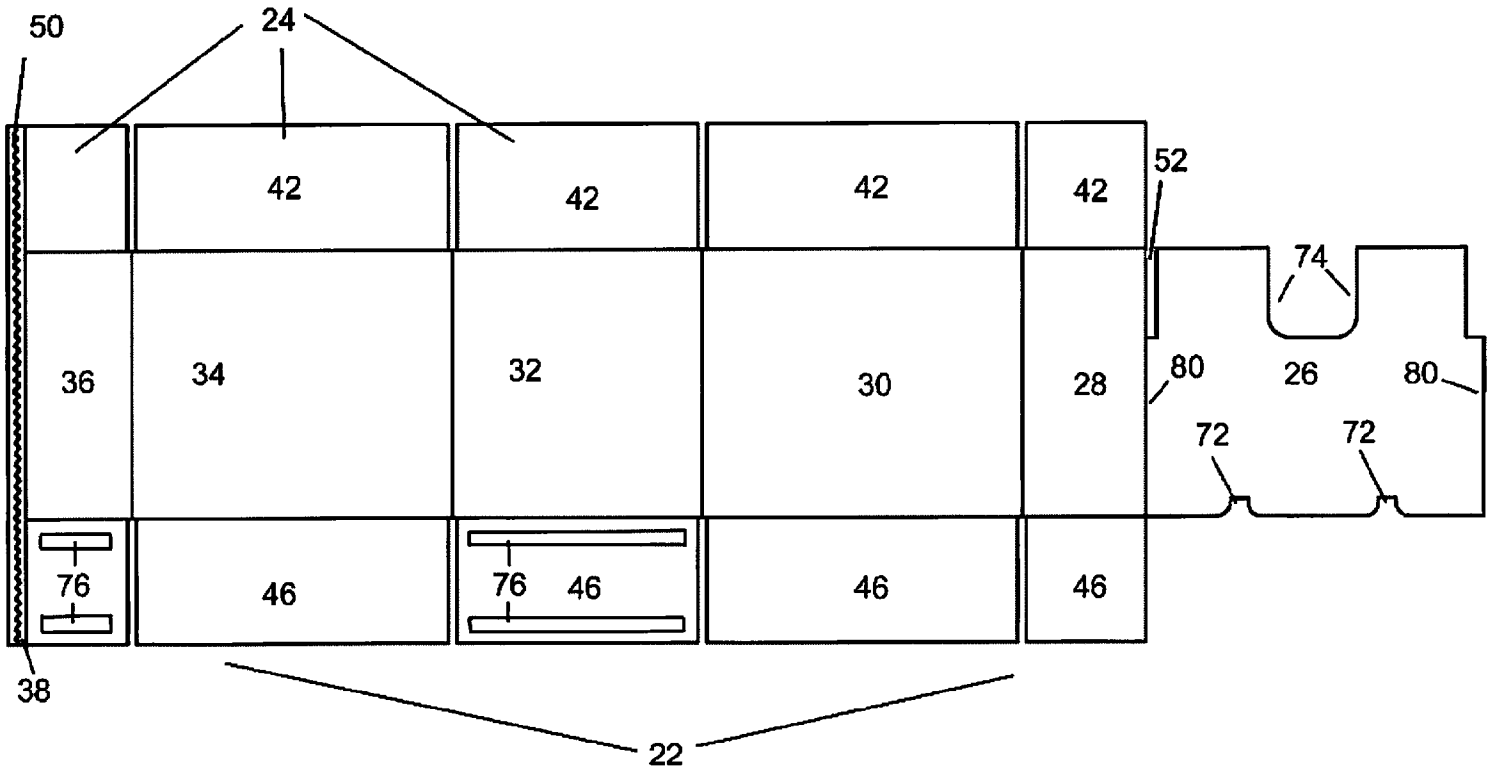
FIG. 3 is a top view of the single sheet from which the box of the present invention is formed.

The box 10 and a single partition 26 can be conveniently formed of a single sheet 22 of cardboard, corrugated paper, or other semi-rigid material. As shown in FIG. 3, the single sheet 22 is scored into multiple panels 24, so that the panels 24 are connected to each other but easily folded along the scored lines between them. A leading panel forms a partition 26 around which the other panels 24 will be wrapped to form the exterior of the box 10. The second connected panel forms part 28 of a width-wise side 40 of the box 10, when folded to be perpendicular to the partition 26. The third connected panel forms a first length-wise side 30 of the box 10, when extending parallel to the partition 26, perpendicular to the first partial width-wise side 28. The fourth connected panel forms a complete width-wise side 32 of the box 10, when folded perpendicular to the first length-wise side 30. The fifth connected panel forms a second length-wise side 34 extending parallel to the partition 26 back towards the width-wise side 40. Finally, the sixth connected panel forms a second partial width-wise side 36, which overlaps the first partial width-wise side 28. A securing means 50, such as glue, permanently attaches the first and second partial width-wise sides 28, 36 to each other to form the joined width-wise side 40. Together, the five panels 28, 30, 32, 34, 36 of the single sheet 22, each having the same height, form the exterior of the box 10.

Each of those five panels 28, 30, 32, 34, 36 is scored to form top flaps 42 suitable for folding together to form a top 44 of the box when the box is in the cube shape 16. Similarly, each of those five panels is scored to form bottom flaps 46 suitable for folding together to form a bottom 48 of the box when the box is in the cube shape. When the bottom flaps 46 are held together by tape or another temporary attachment mechanism (not shown), the box 10 is held in the cube shape 16. When the bottom flaps 46 and top flaps 42 are not held together, the box 10 is easily collapsed to the flat shape 18 shown in FIG. 6, with the partition 26 fitting compactly between the length-wise sides 30, 34.

Figure 2:
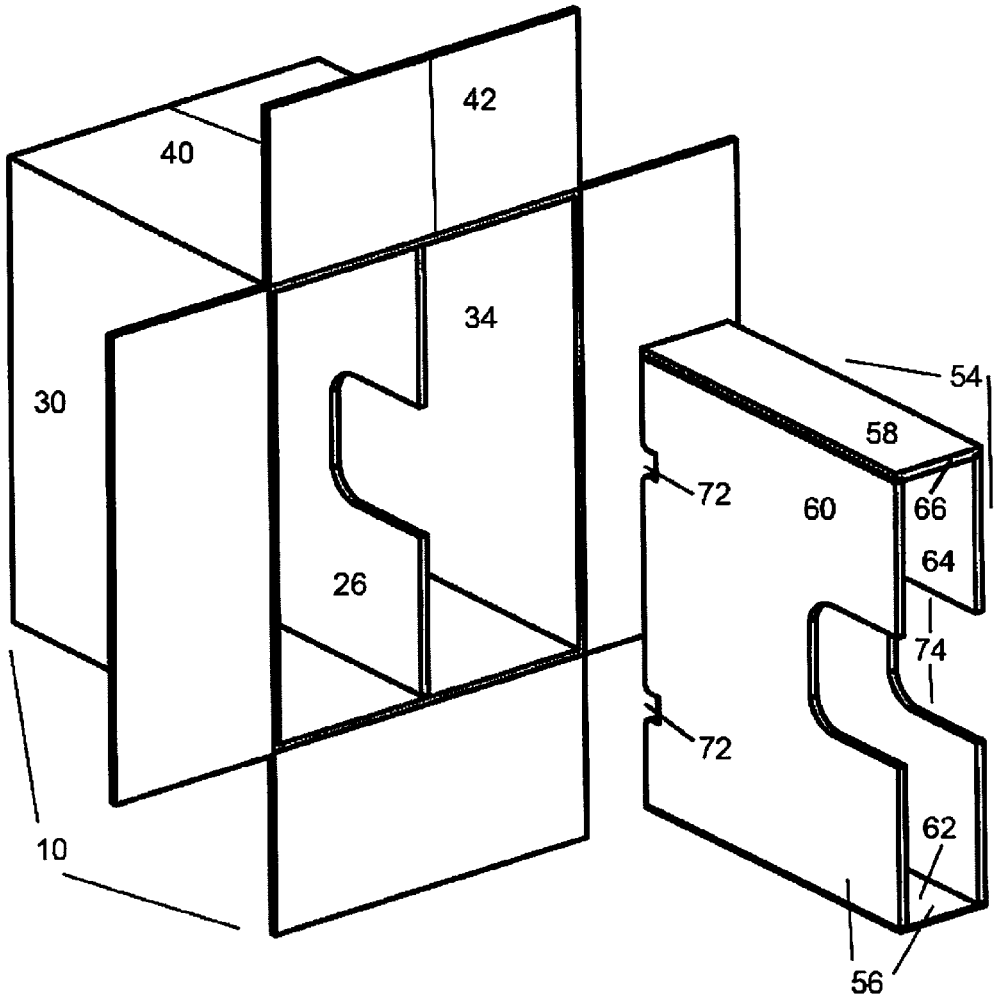
FIG. 2 is a perspective top and side view of the box of the present invention, shown with a single partition in the box and an insert with dual walls not yet inserted in the box.
Figure 4:
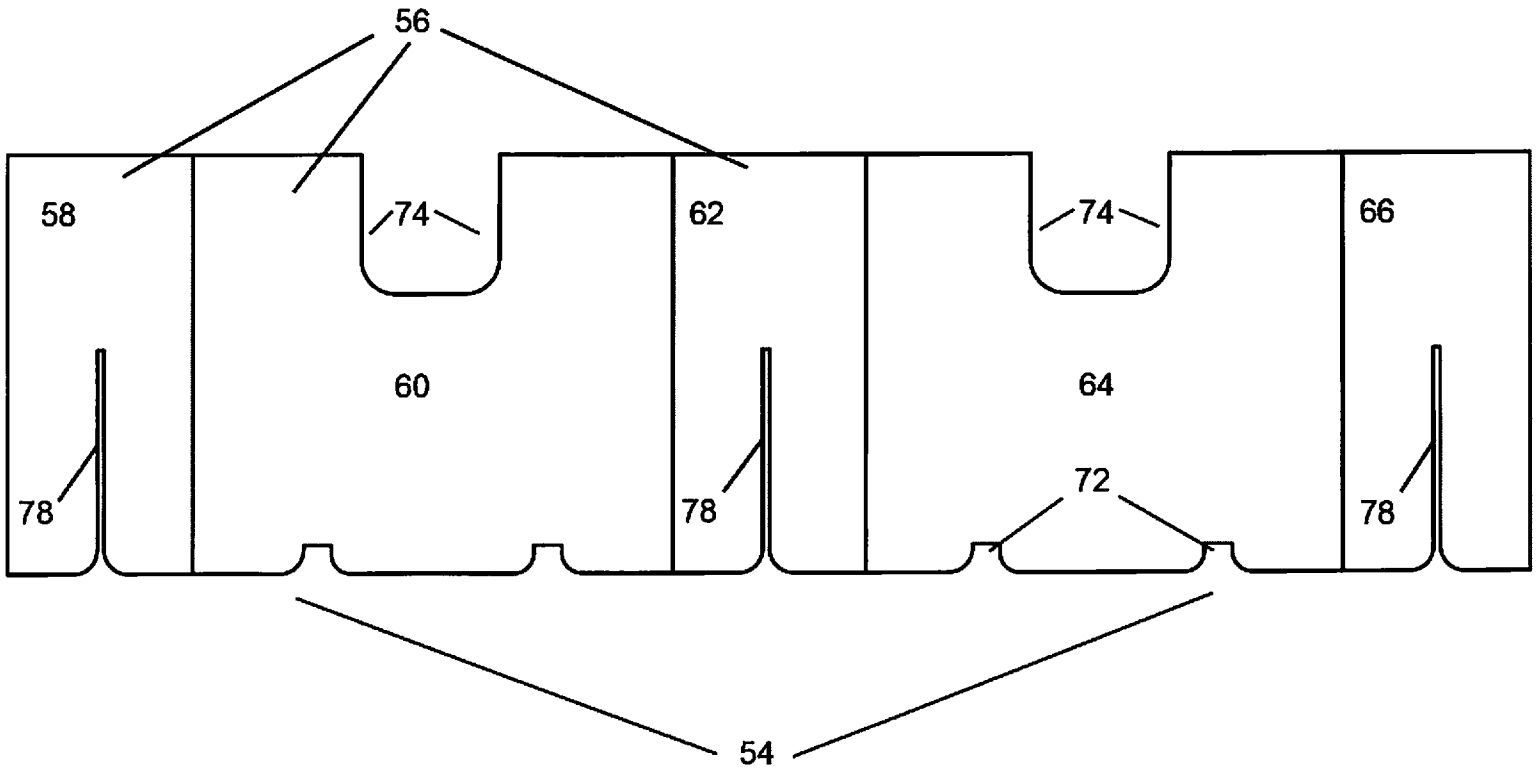
FIG. 4 is a top view of the single sheet from which an insert for the box of the present invention is formed.

In a preferred embodiment of the invention, additional compartments 20 for receiving and holding rectangular products 14 can be easily established by providing an insert 54 which fits snugly within the box 10 to establish additional dividers 60, 64 between the partition 26 and each length-wise side 30, 34, as shown in FIGS. 1 and 2. The walls 60, 64 are formed from a single sheet of material which is inserted into the interior of the box 10. This can be accomplished, as best shown in FIG. 4, by scoring and cutting the single sheet 54 into five segments 56: a first width-wise segment 58, connected to a first wall 60, connected to a second width-wise segment 62, connected to a second wall 64, connected to a third width-wise segment 66. The single sheet 54 is folded into a rectangle suitable for surrounding the partition 26 when inserted in the box 10. The first width-wise segment 58 fits in the box 10 adjacent to a width-wise side 32 or 40. The first wall 60 extends toward the opposite width-wise side 40 or 32 of the box 10, between the partition 26 and a length-wise side 30 or 34 of the box 10. The second width-wise segment 62 is positioned adjacent to the interior of the opposing width-wise side 40 or 32, from which the second wall 64 extends back to the first width-wise segment 58, parallel to the partition 26 and on the opposite side of the partition 26 from the first wall 60. Finally, the third width-wise segment 66 is attached to the first width-wise segment 58, overlapping that first width-wise segment 58 and securing the walls 60, 64 in place as an integrated part of the box 10. Together with the partition 26, the walls 60, 64 create four distinct compartments 20 for holding rectangular products 14 in the box 10.

To enable the first width-wise segment 58, second width-wise segment 62, and third width-wise segment 66 to be held flush against the width-wise sides 32, 40 of the box 10, grooves 78 are beneficially formed in each of those segments 58, 62, 66. The grooves 78 allow each width-wise segment 58, 62, 66 to slide into the box 10 around the opposite edges 80 of the partition 26. Ideally, slots 52 are formed in the upper portion of each edge 80 of the partition 26 to create a separation between that portion of each edge 80 and the adjacent width-wise side 32, 40 of the box 10, so that the rectangular insert 56 can be inserted completely into the box 10, with each width-wise segment 58, 62, 66 held tightly between an edge 80 of the partition 26 and the adjacent box width-wise side 32, 40.

When the box 10 is collapsed to the substantially flat shape 18, the walls 60, 64 are positioned parallel to and between the length-wise sides 30, 34 of the box 10, allowing the box 10 to be compactly stacked with other similar boxes 10 for storage and transport.

Because electronic products can be easily damaged by the jostling associated with transport, it is advantageous to provide cushioning material 76 on the bottom flaps 46 to support products 14 being transported in the box 10. Channels 72 may be formed in the bottom of each wall 60, 64 and the partition 26 to receive the cushioning material 76 when the box 10 is in the cube shape 16. An indentation 74 may be conveniently formed in the top of each wall 60, 64 and the partition 26 to facilitate grasping, inserting, and removing each product 14.

Although the present invention has been described in terms of the presently preferred embodiment, it is to be understood that such disclosure is purely illustrative and is not to be interpreted as limiting. Consequently, without departing from the spirit and scope of the invention, various alterations, modifications, or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

We claim:

1. A box with integrated dividers, comprising:

a front wall;

a rear wall;

a first sidewall connected to the front wall along a first fold line and to the rear wall along a second fold line;

a second sidewall connected to the front wall along a third fold line and to the rear wall along a fourth fold line;

a divider panel connected to at least one of the first sidewall and the second sidewall along a divider panel fold line; and an insert comprising a front insert wall, a rear insert wall, a first insert sidewall, and a second insert sidewall, each of the first insert sidewall and second insert sidewall being connected to at least one of the front insert wall and the rear insert wall along a respective at least one insert fold line, wherein the box has a first configuration in which:

the front wall is positioned parallel to the rear wall and the first and second sidewalls are positioned perpendicular to the front and rear walls and parallel to each other, thereby defining a box interior, the divider panel is positioned parallel to and between the front wall and the rear wall, thereby dividing the box interior into a first compartment and a second compartment, and the insert is positioned within the box interior with the front insert wall and rear insert wall parallel to each other and on opposing sides of the divider panel, thereby dividing the first and second compartments into two sub-compartments each, and wherein the box has a second configuration in which:

the front wall, rear wall, first sidewall, and second sidewall are folded flat along the first, second, third, and fourth fold lines, the front insert wall, rear insert wall, first insert sidewall, and second insert sidewall are folded flat along the at least one insert fold line and sandwiched between the front insert wall, rear insert wall, first insert sidewall, and second insert sidewall, and the divider panel is folded flat along the divider panel fold line and sandwiched between the front insert wall, rear insert wall, first insert sidewall, and second insert sidewall.

2. The box according to claim 1, wherein the front wall, the rear wall, the first sidewall, and the second sidewall include respective top flaps attached thereto along respective top flap fold lines.

3. The box according to claim 1, wherein the front wall, the rear wall, the first sidewall, and the second sidewall include respective bottom flaps attached thereto along respective bottom flap fold lines.

4. The box according to claim 3, further comprising cushioning material attached to one or more of the respective bottom flaps.

5. The box according to claim 1, wherein the first sidewall further comprises: a first partial sidewall and a second partial sidewall partly overlapping the first partial sidewall, and wherein the divider panel is attached to one of the first partial sidewall and the second partial sidewall along the divider panel fold line.

6. The box according to claim 5, wherein at least one of the first partial sidewall and the second partial sidewall further comprises an adhesive to secure the first and second sidewalls to each other where partly overlapping.

7. The box according to claim 1, wherein the insert comprises:

a front insert wall;

a first insert sidewall attached to the front insert wall along a first insert fold line;

a second insert sidewall attached to the front insert wall along a second insert fold line; and a rear insert wall attached to one of the first insert sidewall and the second insert sidewall along a third insert fold line.

8. The box according to claim 7, wherein:

the first insert sidewall includes a first groove extending partially through the first insert sidewall from an edge of the first insert sidewall; and the second insert sidewall includes a second groove extending partially through the second insert sidewall from an edge of the second insert sidewall.

9. The box according to claim 8, wherein the divider panel includes a first slot extending partially through the divider panel from an edge of the divider panel and a second slot extending partially through the divider panel from an edge of the divider panel.

10. The box according to claim 9, wherein the first groove is complementary to the first slot and the second groove is complementary to the second slot such that the insert can mate with the divider panel.

11. The box according to claim 1, wherein at least one of the divider panel, the front insert wall, and the rear insert wall comprises an indentation to facilitate grasping an adjacently-placed product.

12. A box, comprising:

a container comprising a front wall, a rear wall, a first sidewall, and a second sidewall, wherein the front wall, the rear wall, the first sidewall, and the second sidewall are interconnected via a plurality of fold lines to define a box interior;

a divider panel connected to at least the first sidewall via a divider panel fold line and extending through the box interior parallel to the front wall and the rear wall, thereby dividing the box interior into a first compartment and a second compartment; and an insert comprising a front insert wall, a rear insert wall, a first insert sidewall, and a second insert sidewall, wherein the front insert wall, the rear insert wall, the first insert sidewall, and the second insert sidewall are interconnected via a plurality of insert fold lines, wherein the insert is inserted within the box interior with the first insert sidewall adjacent the first sidewall, the second insert sidewall adjacent the second sidewall, and the front insert wall and the rear insert wall extending through the box interior parallel to the front wall and the rear wall, thereby dividing at least one of the first compartment and the second compartment into a pair of sub-compartments, wherein the box has a first configuration in which the container and the insert are formed into respective cuboids, such that one or more products can be placed within the box interior, and wherein the box has a second configuration in which the container is flattened along the plurality of fold lines, the divider panel is flattened along the divider panel fold line within the box interior, and the insert is flattened along the plurality of insert fold lines within the box interior.

13. The box according to claim 12, wherein the insert is inserted into the box interior with the front insert wall and the rear insert wall on opposing sides of the divider panel, thereby dividing the first compartment into a first sub-compartment and a second sub-compartment and dividing the second compartment into a third sub-compartment and a fourth sub-compartment.

14. The box according to claim 12, wherein the container further comprises:

at least one top flap connected to at least one of the front wall, the rear wall, the first side wall, and the second side wall along at least one top flap fold line; and at least one bottom flap connected to at least one of the front wall, the rear wall, the first side wall, and the second side wall along a at least one bottom flap fold line.

15. The box according to claim 14, wherein the container further comprises:

a plurality of top flaps connected to two or more of the front wall, the rear wall, the first side wall, and the second side wall along a plurality of top flap fold lines; and a plurality of bottom flaps connected to two or more of the front wall, the rear wall, the first side wall, and the second side wall along a plurality of bottom flap fold lines.

16. The box according to claim 12, wherein the insert is removably inserted within the box interior with the first insert sidewall adjacent the first sidewall, the second insert sidewall adjacent the second sidewall, and the front insert wall and the rear insert wall extending through the box interior parallel to the front wall and the rear wall, thereby dividing at least one of the first compartment and the second compartment into a pair of sub-compartments.

* * * * *